United States Patent [19]

Johnston

[11] 4,324,003

[45] Apr. 13, 1982

[54] THROAT GUARD

[76] Inventor: Tony Johnston, 96 Devonshire Ave., London, Ontario, Canada, N6C 2H8

[21] Appl. No.: 143,510

[22] Filed: Apr. 24, 1980

[30] Foreign Application Priority Data

Apr. 25, 1979 [CA] Canada ..... 326292

[51] Int. Cl.[3] ..... A41D 13/00

[52] U.S. Cl. ..... 2/2

[58] Field of Search ..... 2/2, 2.1 A

[56] References Cited

U.S. PATENT DOCUMENTS

| | | | |
|---|---|---|---|
| 1,136,307 | 4/1915 | Bourdon | 2/2 |
| 1,256,594 | 2/1918 | Rodal | 2/2 |
| 1,473,099 | 11/1923 | Holmes | 2/2 |
| 3,030,626 | 4/1962 | Shepard | 2/2.1 A |
| 3,189,917 | 6/1965 | Sims | 2/2 X |
| 3,497,872 | 3/1970 | Mitchell | 2/2 |
| 3,514,784 | 6/1970 | McDavid | 2/2 |
| 3,569,713 | 3/1971 | Via | 2/2 X |
| 3,657,739 | 4/1972 | Holmes | 2/2 |
| 3,855,631 | 12/1974 | Ettinger | 2/2 |

*Primary Examiner*—Louis Rimrodt

*Attorney, Agent, or Firm*—Bachman and LaPointe

[57] ABSTRACT

A throat guard which provides protection across the sensitive throat region as disclosed. It is composed of U-shaped bands of semi-rigid flat material, for example leather or semi-rigid plastic that are adapted to overlappingly co-act and to nest, so that when disposed in the nested area they provide an expanse of protection smaller in area then when unnested. Hence, when the band is positioned and placed about the neck, the discrete U-shaped band forms a movable expanse which co-acts with the head between chin and chest to continually provide a protected buffer or covering for the neck. Such device is particularly useful when playing contact sports, such as field hockey, ice hockey or lacrosse.

5 Claims, 5 Drawing Figures

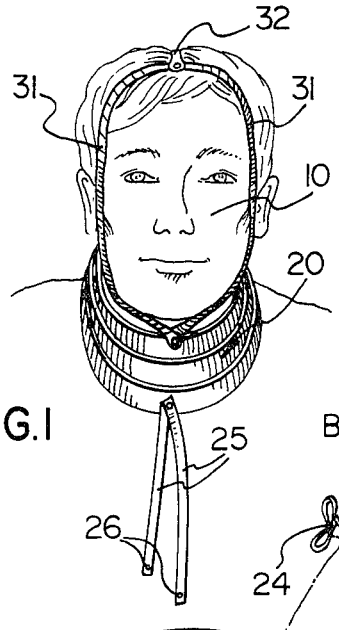
FIG.1
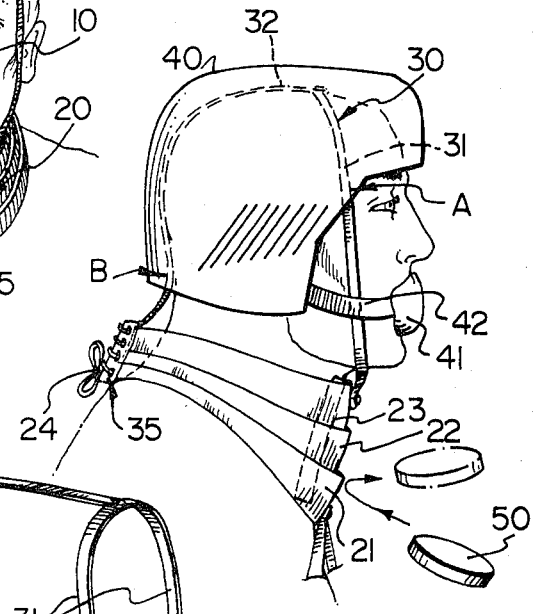
FIG.2
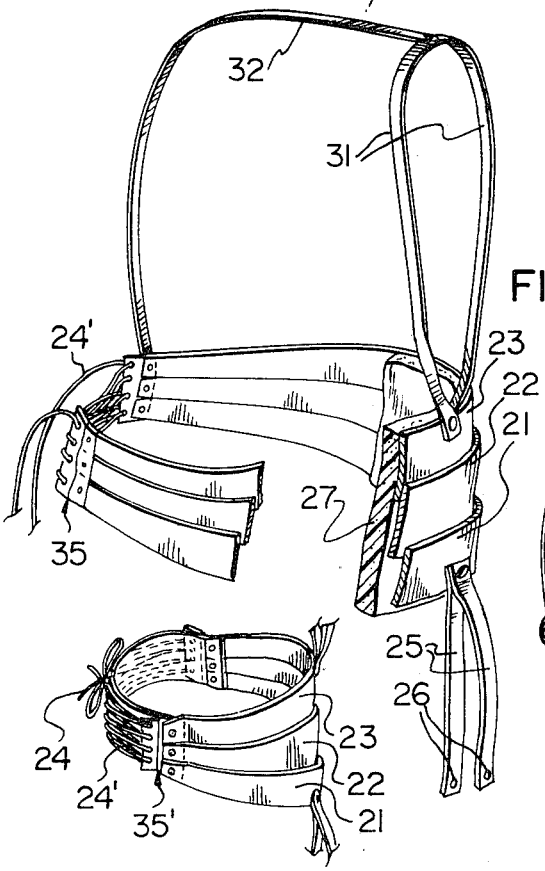
FIG.3
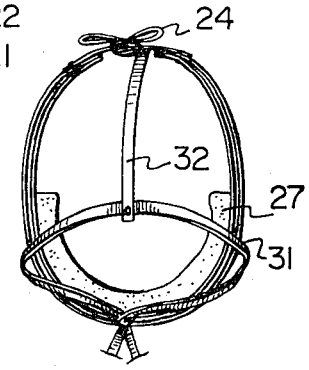
FIG.4
FIG.5

THROAT GUARD

This invention relates to a throat protector device for use by a person. It is particularly useful when playing such sports as field hockey, ice hockey or lacrosse.

It may also have application in other areas where throat protection is desired.

The invention thus comtemplates a throat guard comprising:

(a) discrete, continuously positionable throat covering, U-shaped bands of semirigid flat material adapted to overlappingly co-act and to nest, and to dispose when nested an area of protected expanse over the throat region smaller than when unnested though each band is continuously juxtapositioned;

(b) means for securing the bands about the neck of a person so that the bands extend over the throat region between chin and chest;

(c) means for maintaining one band in contiguous juxtaposition against the chest of the wearer; and, (d) means for urging another one of said bands into close proximity of the chin, whereby head articulation causes the discrete bands to overlappingly co-act and to offer a continuously protective area of sheet material covering the throat region.

The invention will now be described by way of example and with reference to the accompanying drawings in which:

FIG. 1 is the front elevational view of the device.

FIG. 2 is a side elevation of the device of FIG. 1 showing as well a protective head helmet on the wearer and a flying object, such as a puck.

FIG. 3 is a perspective, partially in section, of the constituent parts of the throat guard.

FIG. 4 is a top plan view of the device of FIG. 3.

FIG. 5 is a cutaway perspective of an alternative embodiment of the invention.

Referring to FIG. 1, a wearer with his face 10 is shown with the throat protective guard device 20 embodying the invention. The device 20 may include a circumscribing facial band 31 and a rearwardly projecting band 32 attached to the facial band 31 at the apex above the forehead. This latter band 32 projects backward and extends over and downwardly over the back of the head as clearly seen in FIGS. 2 and 3 to become attached, as by laces24', to the rearward extremities of the uppermost U-shaped throat guard bank 23.

Circumscribing the neck of the wearer are a plurality of semi-rigid flat U-shaped throat bands 21 and 22 and 23 each of which respectively articulates and co-acts relative to adjacent bands; or putting it another way, mate so as to provide accommodation of the chin of the wearer and the relative collapsing of the terminates at eyelet mechanism 35 which allows a cord or lace 24' to be interwoven or laced therebetween such that a bow or knot 24 may be tied to secure the plurality of U-shaped throat bands and hence the guard 20 about the neck of the wearer. Preferably the bands are semi-rigid sheets; leather is a good material, so is plastic. For comfort and impact protection to take up shock, a sponge-like pad 27 is mounted on the interior perimeter or face of each of the U-shaped throat bands 21, 22 and 23 as most clearly seen on FIG. 4.

The lowest throat band 21 is urged against the chest. This may be easily accomplished by two straps 25 with dome fasteners 26 attached at their distal ends. These fasteners are adapted to be mated to each other such whereby the two straps 25 then form a loop. The proximate ends of the straps 25 are stitched to the lowest U-shaped band 21. Now, the lowest throat band 21 may be affixedly attached to clothing or, as is most common in sports, protective shoulder wear such as shoulder pads, chest padding and the like (not shown). This simple expedient constrains the lowest U-shaped throat band 21 into close proximity with the shoulder and chest of the wearer at frontal region of the neck (throat) and also all around the neck as clearly seen in FIG. 1. Similarly, the purpose of the head harnass which includes the circumscribing facial strap 31 and rearward extending head strap 32 is to urge the uppermost throat guard member 23 into proximate or juxtaposed relation with the chin and to hence establish an articulatingly extent for all of the throat bands in the fashion shown in FIGS. 1, 2 and 3. In this way as the head of the wearer is moved up and down for better visability (not shown) each of the throat bands 21, 22 and 23 will respectively articulate and co-act, or mate into each other and hence reduce the area of protective expanse exposed as when the chin of the wearer is closest to his chest while at the same time extend a greater expanse of throat protective area when the face of wearer is normally looking forward or even upward.

Other means of ensuring that the lowest most throat guard member 21 is constrained to constantly urge against the chest of the wearer, other than by use of the depending straps 25 and dome fastener 26 is now obvious. Similarly, the use of the structure of the facial band 31 and rearwardly extending band 32 could be changed particularly if the wearer employs a protective helmet 40, much as seen in FIG. 2.

FIG. 2 illustrates the use of the embodiment just described as an undergarment to protective head gear on helmet 40. It could be as well incorporated, as those skilled in the art will now appreciate, as part of the head gear 40. In that respect, the portions of the band 31 which project beyond the head gear would exist but the facial band 31, rather than circumscribing the total facial region as shown in FIG. 4, would attach itself onto the left and right lateral sides of the head gear at point "A" as shown in FIG. 2. Likewise, the rearwardly extending band 32 would not extend from its union with the circumscribing facial band 31 but would extend from the base and rear center section of the head gear, e.g., point "B" and extend downward to interconnect either with the bow 24 and its lace 24' or with the eyelet mechanism 35 or with other similar means.

FIG. 5 shows yet a further embodiment wherein the length of the arms of each U-shaped throat band is shorter in length than those of FIGS. 1–4. This requires a longer lace 24.

The embodiments of the invention in which an exclusive property or privilege is claimed are defined as follows:

1. A throat guard comprising:

(a) a discrete, continuously positionable throat covering of U-shaped bands of semirigid flat material adapted to overlapping co-act and to nest, and to dispose when nested an area of protected expanse over the throat region smaller than when unnested though each band is continuously juxtapositioned;

(b) means for securing the bands about the neck of a person so that the bands extend over the throat region between chin and chest;

(c) means for maintaining one band in contiguous juxtaposition against the chest of the wearer; and, (d) means for urging another one of said bands into close proximity of the chin, whereby head articulation causes the discrete bands to overlappingly co-act and to offer a continuously protective area of sheet material covering the throat region.

2. The guard as claimed in claim 1 wherein the bands are sheet plastic.

3. The guard as claimed in claim 1 wherein the bands are of leather.

4. A guard as claimed in claims 1, 2 or 3 wherein a resilient material is in juxtaposition against the band disposed between the bands and the throat of the wearer.

5. A guard as claimed in claims 1, 2 or 3 including strap means attached thereto to circumvent the head.

* * * * *